United States Patent [19]

Wankel

[11] 4,203,381

[45] May 20, 1980

[54] WATER FOIL

[76] Inventor: Felix Wankel, Fraunhoferstr. 10, 899 Lindau (B), Fed. Rep. of Germany

[21] Appl. No.: 852,680

[22] Filed: Nov. 18, 1977

Related U.S. Application Data

[60] Continuation of Ser. No. 697,780, Jun. 21, 1976, abandoned, which is a division of Ser. No. 588,519, Jun. 19, 1975, abandoned.

[30] Foreign Application Priority Data

Jun. 20, 1974 [DE] Fed. Rep. of Germany ..... 2429669
Aug. 20, 1974 [DE] Fed. Rep. of Germany ..... 2439822

[51] Int. Cl.[2] ..... B63B 1/24
[52] U.S. Cl. ..... 114/274
[58] Field of Search ..... 9/310 R, 310 C; 114/61, 114/271, 274, 279, 280, 282, 283, 284

[56] References Cited

U.S. PATENT DOCUMENTS

| | | | |
|---|---|---|---|
| 1,515,649 | 11/1924 | Baldwin | 114/274 |
| 1,630,623 | 5/1927 | Ludasy | 114/274 |
| 1,720,167 | 7/1929 | Clifton | 114/283 |
| 1,805,131 | 5/1931 | Donaldson | 114/283 |
| 1,875,344 | 9/1932 | Kloen | 114/280 |
| 3,227,122 | 1/1966 | Noe | 114/271 |

*Primary Examiner*—Trygve M. Blix
*Assistant Examiner*—Jesus D. Sotelo
*Attorney, Agent, or Firm*—Becker & Becker, Inc.

[57] ABSTRACT

A sliding boat having supporting members respectively connected to opposite sides of the hull and projecting therefrom in cantilever fashion while carrying a plurality of water sliding foils at the free end of said supporting members. Each of the sliding foils comprises a plurality of relatively long and narrow strips extending in the longitudinal direction of the boat and being spaced from each other in the transverse direction of the strips so as to form a gap therebetween.

1 Claim, 5 Drawing Figures

WATER FOIL

This is a continuation application of Ser. No. 697,780, filed June 21, 1976 (now abandoned), which is a division of application Ser. No. 588,519, filed June 19, 1975 now abandoned.

The present invention relates to a water foil for boats with sliding foils. The purpose of such water foils consists in lifting the boat out of the water during its drive and to carry it above the water surface in order to reduce the displacement work and the water resistance of the hull of the boat. The sliding surfaces or water foils may be formed by surfaces of the hull itself or may be fin-shaped or wing-shaped parts spaced from the hull. Such fin or wing-like parts, in contrast to supporting wings around which the water flows on all sides, have only their bottom side resting on the water. These water foils in addition to having a reduced water resistance have the advantage that they are not subjected to the danger of cavitation, inasmuch as they do not have an underpressure area. Therefore, very high driving speeds are possible. However, the drawback is encountered that even slight waves may cause such hard shocks that they will be intolerable at high speeds for the boat occupants. This drawback is particularly great when sliding surfaces of wide span and short extension in the driving direction are involved. Also, the inversed form of the sliding surfaces in the driving direction as it is employed, for instance, with water skis in which the extension in the driving direction is great and the width transverse to the driving direction is short still brings about shock stresses although to a lesser extent when driving upon waves.

There has furthermore become known a hull with longitudinally extending sliding surfaces or water foils of V-shaped cross section which in transverse direction to the driving direction are located adjacent to each other while forming a step with each other. While such boats are markedly less sensitive than sliding boats with flat hull cross sections with regard to shocks caused by waves, also this type of boat will at higher speed and when encountering waves quickly reach the limit where the shocks become unbearable.

It is, therefore, an object of the present invention to provide a boat with water foils in which the sensitivity with regard to the height of the waves will be considerably reduced.

These and other objects and advantages of the invention will appear more clearly from the following specification, in connection with the accompanying drawings, in which.

The water foil according to the present invention is characterized in that its sliding surface stands off and that it is composed of a plurality of narrow sliding strips which extend with their longitudinal axes in the driving direction while likewise standing off, said sliding strips leaving gaps between each other in the driving direction so that a grate-like structure is formed. This arrangement makes it possible when shock waves occur to permit the water quickly to flow off laterally and also makes possible a quick reduction of the water pressure which causes the hard shocks.

The sliding strips may be resiliently designed. It is furthermore suggested to interconnect the sliding strips by means of a short supporting part extending in the driving direction, while the connection of the sliding strips to the supporting part is effected by means of spacer webs which are narrow in driving direction.

These features bring about that each sliding strip will adapt itself to the movement of the waves and can swing freely and that the connections between the sliding strips and with the hull of the boat will when flooding the sliding strips offer the water a minimum of resistance.

Figure 1:
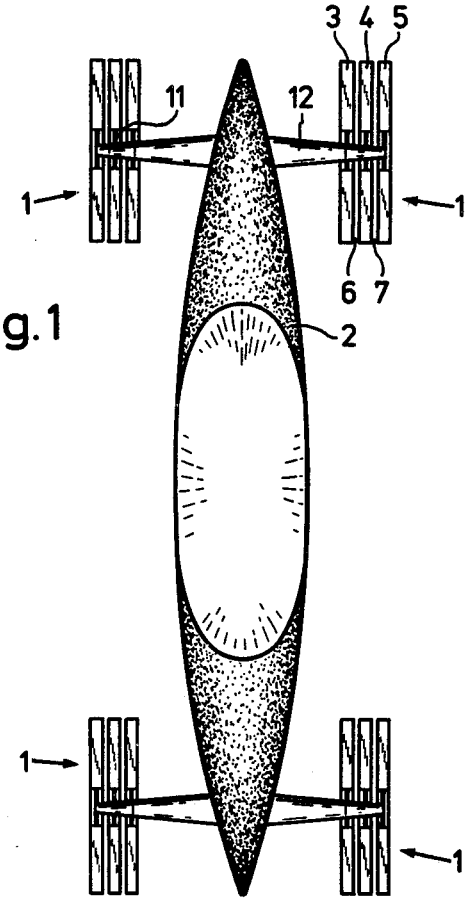
FIG. 1 is a top view of a boat according to the present invention.
Figure 2:
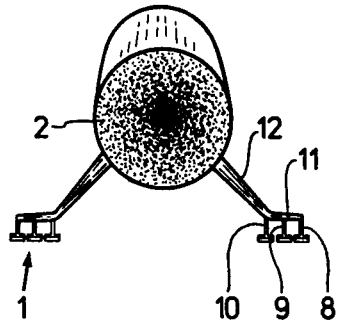
FIG. 2 is the front view of the boat according to FIG. 1.

Referring now to the drawings in detail, and FIGS. 1 and 2 thereof in particular, the four sliding foils or sliding surfaces 1 of the boat 2 are arranged in a grate-like manner and divided in driving direction into individual sliding strips 3, 4, 5 between which longitudinal gaps 6, 7 remain. Each sliding strip forms a relatively long and narrow strip having its longitudinal axis extending in the driving direction of the boat. The sliding strips are supported at their center portion by means of short spacer webs 8, 9, 10 connected to a supporting member 11. Each supporting member is rigid or in order to adjust the angle of inclination of said sliding surfaces is connected to the supporting arm 12 so as to be pivotable about its longitudinal axis, said supporting arm 12 carrying the hull of the boat 2.

The sliding strips are made of elastic material. Their connection at the central portion of the said strips brings about that they can spring along their entire extension. This brings about an additional softness of the driving behavior of the boat when waves impact upon the boat or the sliding foils or when the sliding foils enter a relatively deep wave valley. The sliding strips 3, 4, 5 will in this way be able to adapt themselves to the surface of the waves independently of each other and the sliding surface thus no longer represents a rigid structure. Furthermore, when impacting upon the water surface, the sliding strips by bending temporarily form a steeper angle of attack whereby the strips are prevented from, so-to-speak, boring themselves into the water surface.

For an unimpeded action, as far as possible, of the longitudinal gaps 6, 7 as well as for the spring behavior of the individual sliding strips 3, 4, 5, it is advantageous to connect the sliding strips with each other by means of a supporting member 11 which is short in the driving direction. Furthermore, it is advantageous to effect the connection between said supporting member and the sliding strips only by means of narrow spacer webs 8, 9, 10 which offer only slight resistance in the driving direction of the boat.

Merely by way of example, it may be mentioned that with a boat of the above mentioned type designed for driving 100 km per hour, the sliding strips 3, 4, 5 may have a length of from 1 to 1.5 meters and may have a width of from 80 to 100 milimeters, preferably 90 millimeters if on the boat a foil or slide surface arrangement is provided at the bow and at the stern in conformity with the showing in FIG. 1. A boat of the just mentioned type has been tested at waves having a height up to 1 meter and following closely each other, at the above mentioned speed of 100 km per hour. During this test, no material vibrations and other intolerable hard shock heretofore common with heretofore known sliding boats of corresponding size have been encountered, but the boat has only carried out soft movements.

Figure 3:
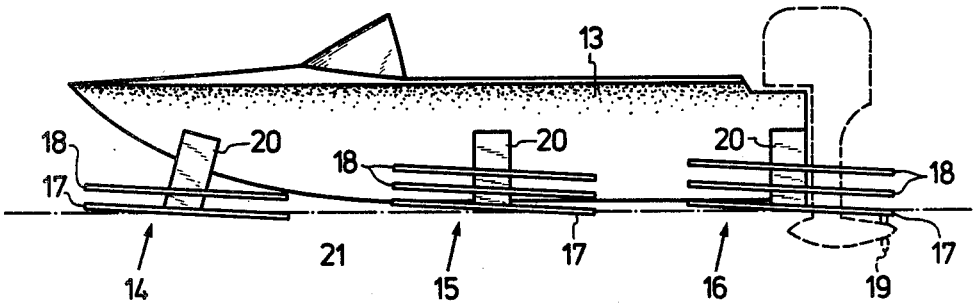
FIG. 3 is a side view of a modified boat according to the invention.
Figure 4:
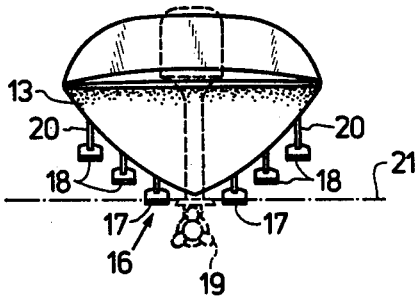
FIG. 4 shows the stern of the boat according to FIG. 3.
Figure 5:
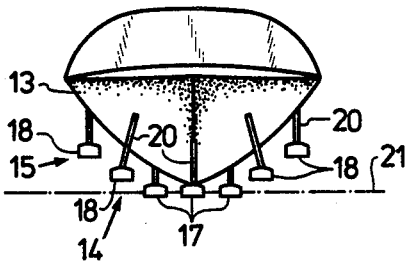
FIG. 5 shows the bow of the boat according to FIG. 3.

Referring now to FIGS. 3 to 5, the modified boat shown therein has its hull 13 which has a V-shaped cross section provided with three groups 14, 15, 16 of sliding strips. The group 14 which is closest to the bow has an inner sliding strip 17 and an outer strip 18 on each side of the bow. The intermediate series 15 comprises two inner sliding strips 17 and on both sides thereof two outer sliding strips 18. The series 16 at the stern has two inner sliding strips 17 and on both sides thereof two outer sliding strips 18. The series 16 lacks the intermediate sliding surface in order to leave space for the propeller 19. All sliding strips 17 and 18 are so located that the transverse axis of the sliding surface is parallel to the water surface. The sliding strips 17 and 18 are by means of short spacer webs 20 directly connected to the wall of the hull 13 and its construction. The cross section of these spacer webs is in the driving direction of the boat as narrow as possible in order to offer a minimum flow resistance. Between the sliding strips 17, 18 narrow gaps are open through which the water when being impacted upon by the sliding surface can quickly escape and without causing hard shocks.

The outer sliding surfaces 18 may, according to another embodiment of the invention, have the transverse axis of their sliding surface extend parallel to the inclination of the cross section of the hull 13. All sliding surfaces 17 and 18 have a small angle of attack relative to the water surface plane and are resilient in themselves.

When the boat starts, it quickly rises onto the lowermost, which means substantially onto the inner sliding strip 17, in conformity with the dash line 21 of FIG. 3 which represents the water surface at full speed of the boat. When the boat drives straightforwardly, the boat rests on the water with the surface required for the total speed while the sliding strips softly equalize uneveness in the waves and at the same time dampen shocks without the boat being able to rock itself up with regard to encountered shocks. When the boat passes through a curve, the boat will lie on one of its sides while due to the stepped sliding strip arrangement, the necessary impacting surface remains. The stepwise arrangement of the outer sliding strips permits a stable drive through curves at which the boat, similar to heretofore known customary boats with stepped V-cross section will due to the screw lift adapt itself to the curve and will thus retain the same favorable driving properties as with the straightforward drive.

Due to the multiple arrangement of the sliding strip series one behind the other, also shorter as well as longer wave intervals can be equalized with the boat being unable to rock itself up concerning the shocks encountered thereby. The sliding surface arrangement according to FIGS. 3–5 likewise affords a very satisfactory shock absorption while the boat drives softly.

It is, of course, to be understood that the present invention is, by no means, limited to the specific showing in the drawings, but also comprises any modifications within the scope of the appended claims.

What I claim is:

1. A body for movement over the surface of the water, said body having a plurality of foil structures for supporting said body on the surface of the water, which are formed of longitudinal foil strips, each strip not exceeding 100 mm. in width and having a length much greater than its width, and extending in the direction of movement, said foil structures including two structures on each side of said body and spaced longitudinally in the direction of movement with the structures on opposite sides transversely spaced, at least two of said structures opposite each other on the opposite sides being adjacent one end of the body, each of said two opposite, transversely spaced structures being formed by a plurality of said foil strips transversely spaced and parallel to each other, with the foil strips also vertically spaced so said strips of each of said two opposite structures lie at different levels, the strip closest to the body being at the lowest level.

* * * * *